US007337585B1

(12) United States Patent
Bobbit

(10) Patent No.: US 7,337,585 B1
(45) Date of Patent: Mar. 4, 2008

(54) LAWN CRYPT COVERING SYSTEM AND METHOD

(75) Inventor: Gary Bobbit, San Bernardino, CA (US)

(73) Assignees: Gary M. Bobbitt, San Bernardino, CA (US); Patricia A. Bobbitt, San Bernardino, CA (US)

( * ) Notice: Subject to any disclaimer, the term of this patent is extended or adjusted under 35 U.S.C. 154(b) by 267 days.

(21) Appl. No.: 11/029,633

(22) Filed: Jan. 4, 2005

(51) Int. Cl.
*E04H 13/00* (2006.01)

(52) U.S. Cl. ..... 52/128; 27/30; 52/139

(58) Field of Classification Search ..... 27/30, 27/35; 52/128, 133, 139, 140; 428/17
See application file for complete search history.

(56) References Cited

U.S. PATENT DOCUMENTS

| | | | | |
|---|---|---|---|---|
| 324,167 | A | 8/1885 | Robey | |
| 510,696 | A | 12/1893 | Mease | |
| 1,004,273 | A | 9/1911 | Johnson | |
| 1,773,865 | A | 8/1930 | Rothenberger | |
| 1,815,883 | A | 7/1931 | Davis | |
| 1,932,792 | A | 10/1933 | Loresch | |
| 2,015,889 | A | 10/1935 | Fineman | |
| 2,024,047 | A | 12/1935 | Kropp | |
| 2,034,633 | A | 3/1936 | Roberts | |
| 2,347,440 | A * | 4/1944 | Skolnik | 52/139 |
| 2,913,895 | A | 11/1959 | Blasius et al. | |
| 3,157,557 | A * | 11/1964 | Palmer | 428/17 |
| 3,230,674 | A | 1/1966 | Christensen | |
| 3,295,271 | A | 1/1967 | Dorris | |
| 3,565,742 | A * | 2/1971 | Stephens et al. | 428/356 |
| 3,581,452 | A | 6/1971 | Jalbert | |
| 3,661,687 | A | 5/1972 | Spinney et al. | |
| 3,722,155 | A | 3/1973 | Glock et al. | |
| 3,772,826 | A | 11/1973 | Ferver | |
| 3,897,663 | A | 8/1975 | Gaul | |
| 3,958,378 | A | 5/1976 | Omeechevarria | |
| 3,978,627 | A | 9/1976 | Booth | |
| 4,064,664 | A | 12/1977 | Gaul | |
| 4,102,098 | A | 7/1978 | Duwe | |
| 4,128,981 | A | 12/1978 | Juba | |
| 4,162,289 | A | 7/1979 | Gomez et al. | |
| 4,200,964 | A | 5/1980 | Freitag | |
| 4,242,389 | A | 12/1980 | Howell | |

(Continued)

FOREIGN PATENT DOCUMENTS

| | | |
|---|---|---|
| WO | WO 91/04381 | 4/1991 |

OTHER PUBLICATIONS

"Double-Depth Lawn Crypts" by Fraser Way Prekast. 2 pages. http://www.bannertown.com/lawn_crypts.htm.

*Primary Examiner*—William L. Miller
(74) *Attorney, Agent, or Firm*—Knobbe, Martens, Olson & Bear LLP

(57) ABSTRACT

A lawn crypt covering system that can be easily attached to and removed from a crypt lid is provided. The covering system generally includes a lightweight, rigid base and an artificial lawn attached thereto. The covering system is adapted to removably attach to mounting structures formed on the crypt lid by using fasteners. The mounting structures are configured to receive fasteners for attaching the covering system to the lid. Recessed areas can be formed on the crypt lid to accommodate the mounting structures. A leveling device such as shims can also be placed between the lightweight base and crypt lid to adjust for settling of the crypts over time.

16 Claims, 5 Drawing Sheets

U.S. PATENT DOCUMENTS

| | | | |
|---|---|---|---|
| 4,648,219 | A | 3/1987 | Johnston, Sr. |
| 5,375,940 | A | 12/1994 | Kobayashi |
| 5,634,311 | A | 6/1997 | Carlton |
| 5,740,637 | A | 4/1998 | Snow |
| 5,746,030 | A | 5/1998 | Sannipoli, Sr. |
| 5,894,699 | A | 4/1999 | Fulton et al. |
| 6,105,315 | A | 8/2000 | Stoecklein et al. |
| 6,176,317 | B1 | 1/2001 | Sepich |
| 6,243,997 | B1 | 6/2001 | Sannipoli |
| 6,324,793 | B1 | 12/2001 | Klanke |
| 6,370,745 | B1 | 4/2002 | Kele et al. |
| 2004/0211129 | A1 | 10/2004 | Sannipoli, Sr. et al. |

* cited by examiner

LAWN CRYPT COVERING SYSTEM AND METHOD

BACKGROUND OF THE INVENTION

1. Field of the Invention

This invention relates generally to below ground burial structures, and more particularly, to a lawn crypt covering system.

2. Description of the Related Art

In an effort to conserve cemetery space, the traditional practice of excavating individual grave sites for interment of each casket has been gradually replaced by the use of lawn crypts. Lawn crypts generally refer to an array of burial vaults installed below ground and positioned side-by-side in rows. Each crypt is typically a rectangular, concrete enclosure that may be of single or double depth and configured to enclose one or more caskets therein. The crypts are usually spaced in close proximity to one another to provide efficient use of cemetery space.

The lawn crypts are typically covered by concrete lids configured to fit over the opening of the crypt. The crypt lids are in turn covered by soil and lawn that are flush with the ground. A double depth lawn crypt is described in U.S. Pat. No. 5,746,030 to Sannipoli, while a modified lid for such a crypt, incorporating a headstone support, is described in U.S. Pat. No. 6,243,997, the entirety of each of which is hereby incorporated by reference.

One problem associated with cemeteries utilizing conventional lawn crypts is that a large amount of digging has to take place during each interment when access to the crypt is needed. This often involves driving heavy earth moving equipment over the lawn to the grave site, which often damages the grass. It also usually requires digging down 12 to 18 inches below grade level to expose the lid of the crypt and then replace the dirt and lawn over the crypt lid when the burial procedure is complete. It can be appreciated that removing and replacing lawn and soil are very labor intensive and costly processes. While artificial turf materials have been developed to cover lawn crypts such as that disclosed in U.S. Pat. No. 3,722,155, these coverings are usually large sheets anchored adjacent to the edges of pathways surrounding the crypts. Since each sheet typically extends across several crypt lids, the sheet removal process is more cumbersome and labor intensive. Moreover, these coverings are typically permanently attached to the surface of the crypt lid by an adhesive or tape, which makes replacement of the covering very difficult if not impossible.

In view of the foregoing, there is a need for an improved covering system for lawn crypts which permits easy and convenient attachment and removal of the covering.

SUMMARY OF THE INVENTION

In one aspect, the preferred embodiments of the present invention provide a lawn crypt covering system. The system comprises a crypt having a mounting surface attached thereto. The mounting surface is preferably configured to receive a fastener. The system further includes a covering having a lightweight base support and a layer of artificial lawn attached thereto. Preferably, at least one fastener is configured to attach the covering to the mounting surface on the crypt so as to secure the covering to the crypt. In one embodiment, the crypt comprises a crypt lid having one or more recessed areas. Preferably, the mounting surface is formed in the recessed. In certain embodiments, the recessed area extends inwardly from at least one edge of the crypt lid for about ⅜ inch. In one embodiment, the mounting surface is preferably nailable and the support base is made of a water resistant, composite material selected from the group consisting of fiberglass, FRP, ABS, PVC, and combinations thereof. In another embodiment, bolts are positioned on an upper surface of the crypt lid and extend through the covering to facilitate removal of the lid without disturbing the covering. In some embodiments, a grave identification plate and vase holder, preferably made of granite or bronze, can be formed on an upper surface of the crypt lid. In certain preferred embodiments, the system further includes a leveling device such as a shim that is positioned between the base support and the crypt lid to adjust for settling of the crypt.

In another aspect, the preferred embodiments of the present invention provide a lawn crypt covering system. The system comprises a lawn crypt lid having an upper surface comprising at least one recessed area. The recessed area is configured to receive a mounting structure, which provides a mounting surface for a fastener. The system further includes a covering comprising a man-made material resembling grass, wherein the covering is removably attached to the mounting structure via the fastener. In one embodiment, the recessed area is formed on the outer periphery of the upper surface of the crypt lid. In another embodiment, the mounting structure comprises an elongated, hollow material extending along the recessed area. Preferably, the fastener is selected from the group consisting of nails, screws, snaps, and clips.

In yet another aspect, the preferred embodiments of the present invention provide a method of covering a lawn crypt. The method includes attaching a mounting structure to the lawn crypt wherein the mounting structure is configured to receive a fastening device. Preferably, the mounting structure is substantially flush with an upper surface of the crypt. The method further includes forming a covering comprising an artificial lawn attached to a support base and securing the covering to the crypt by removably attaching the fastening device to the mounting structure. In one embodiment, the fastening device is extended through the covering into the mounting structure. Preferably, the mounting structure is attached to a crypt lid.

In yet another aspect, the preferred embodiments of the present invention provide a lid for covering a lawn crypt. The lid comprises a generally rectangular member configured to cover an upper opening of the lawn crypt. Preferably, the rectangular member has at least one region that is recessed relative to a top surface of the lid. In one embodiment, the recessed region is configured to receive a mounting device for securing a cover to the top surface of the lid. In another embodiment, the recessed region extends along the outer periphery of the rectangular member. In certain implementations, the rectangular member comprises at least two discrete sections, wherein the sections are positioned adjacent to each other and each section can be moved independently of the other section.

DETAILED DESCRIPTION OF THE PREFERRED EMBODIMENT

Figure 1:
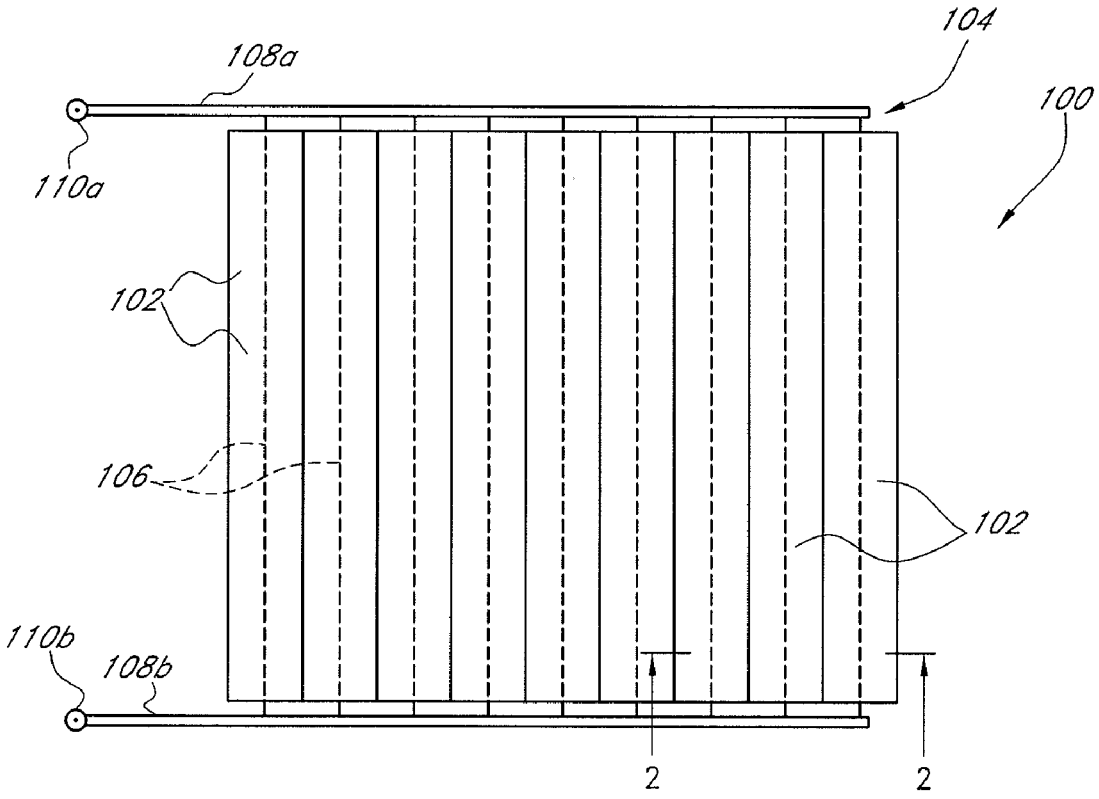
FIG. 1 is a schematic illustration of a lawn crypt system according to a preferred embodiment of the present invention.

References will now be made to the drawings wherein like numerals refer to like parts throughout. FIG. 1 is a schematic illustration of a lawn crypt system 100 according to one preferred embodiment of the present invention. The illustrated system is for a multiple burial site with a plurality of lawn crypts, but it will be understood that the same system may be applied to a single or family burial site, such as a family estate containing one or two crypts. As shown in FIG. 1, the lawn crypt system 100 includes a plurality of single or double depth crypts 102, or a mixture of single and double depth crypts, buried in a single hole dug into the earth to a predetermined depth, and arranged in an array of rows of crypts positioned side-by-side in each row. A suitable drainage system 104 for liquids and gases may be embedded in the ground prior to placement of the crypts 102. In one embodiment, the system 100 includes a series of perforated pipes 106, each pipe running under a line of crypts 102 as indicated in FIG. 1. Opposite ends of each pipe 106 are preferably connected to inlet and outlet pipes 108*a*, 108*b* running along opposite ends of the array. In some implementations, vertical stand pipes 110*a*, 110*b* preferably at least ten feet in height are connected to the end of each pipe 108*a*, 108*b* at a distance from the array of lawn crypts for allowing venting of gases.

Figure 2:
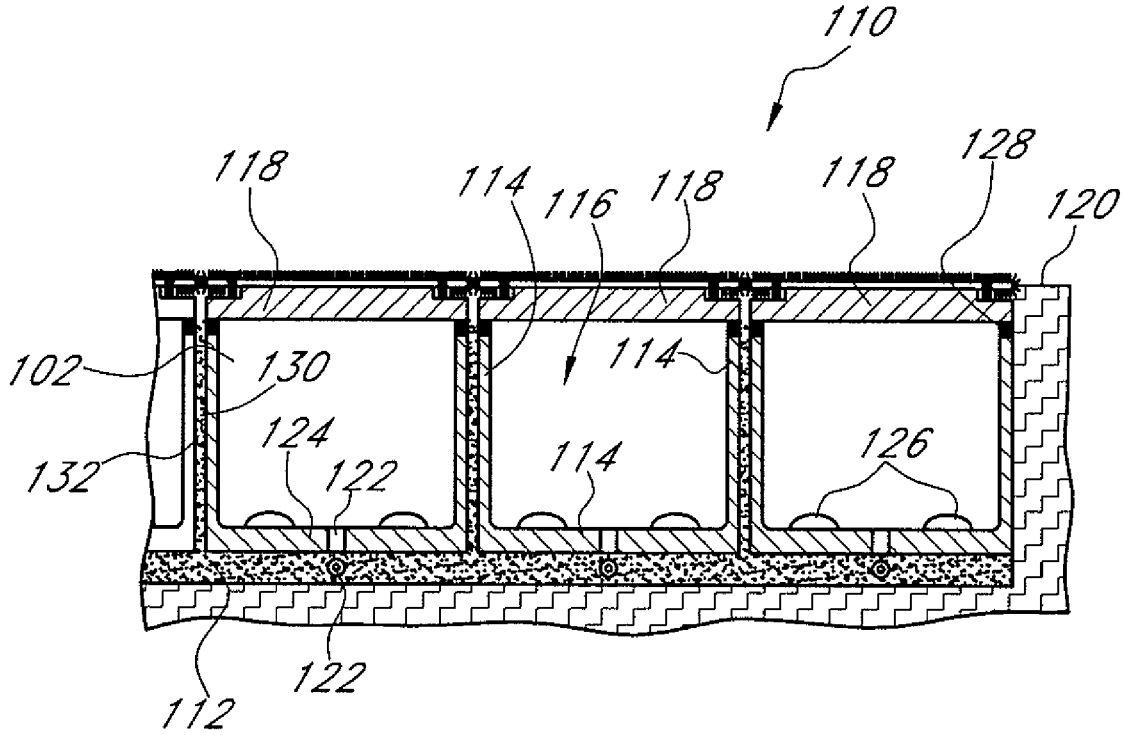
FIG. 2 is a cross-section view of the lawn crypt system of FIG. 1.

FIG. 2 provides a cross-section view of the lawn crypt system 100. As shown in FIG. 2, a layer of porous fill material 112 such as gravel can be placed into the bottom of the hole before lowering in the crypts 102. Each crypt 102 comprises a plurality of walls 114 arranged to form an enclosure 116 and a crypt lid 118 configured to cover the enclosure 116. The crypt walls 114 and lids 118 are preferably made of a strong and durable material such as concrete. In certain preferred embodiments, the crypt lids 118 are substantially at grade level 120 when installed and are configured to facilitate mounting as well as removal of a man-made covering material.

In the embodiment shown in FIG. 2, each crypt has two spaced drain holes 122 in its base 124, and typical gasket risers 126 are also provided on the base. In the case of a double depth lawn crypt, a suitable panel will be positioned approximately half way up the crypt for supporting a second casket, as described in U.S. Pat. No. 5,746,030 cited above. A sealing gasket 128 of rubber or the like can be provided between the upper end of the crypt walls 114 and the lid 118, for preventing or limiting leakage of gases upwardly out of the crypt in the cemetery area. Alternatively, instead of using the sealing gasket 128, each lid 118 may be permanently secured to the upper end of the crypt 102 after the final interment. The lid 118 may be secured by a suitable non-porous bonding material to substantially deter escape of gases in an upward direction. This also helps to ensure that any such gases will be directed along the pipes 106, 108*a*, 108*b* to the outlet stand pipes 110*a*, 1110*b*. As also shown in FIG. 2, the crypts 102 are positioned with a small gap 130, preferably of the order of half an inch, between adjacent crypts in each row. The gap 130 can be filled with a non-porous fill material 132 such as sand and/or gravel to further limit upward escape of any gas resulting from decomposition.

Figure 3A:
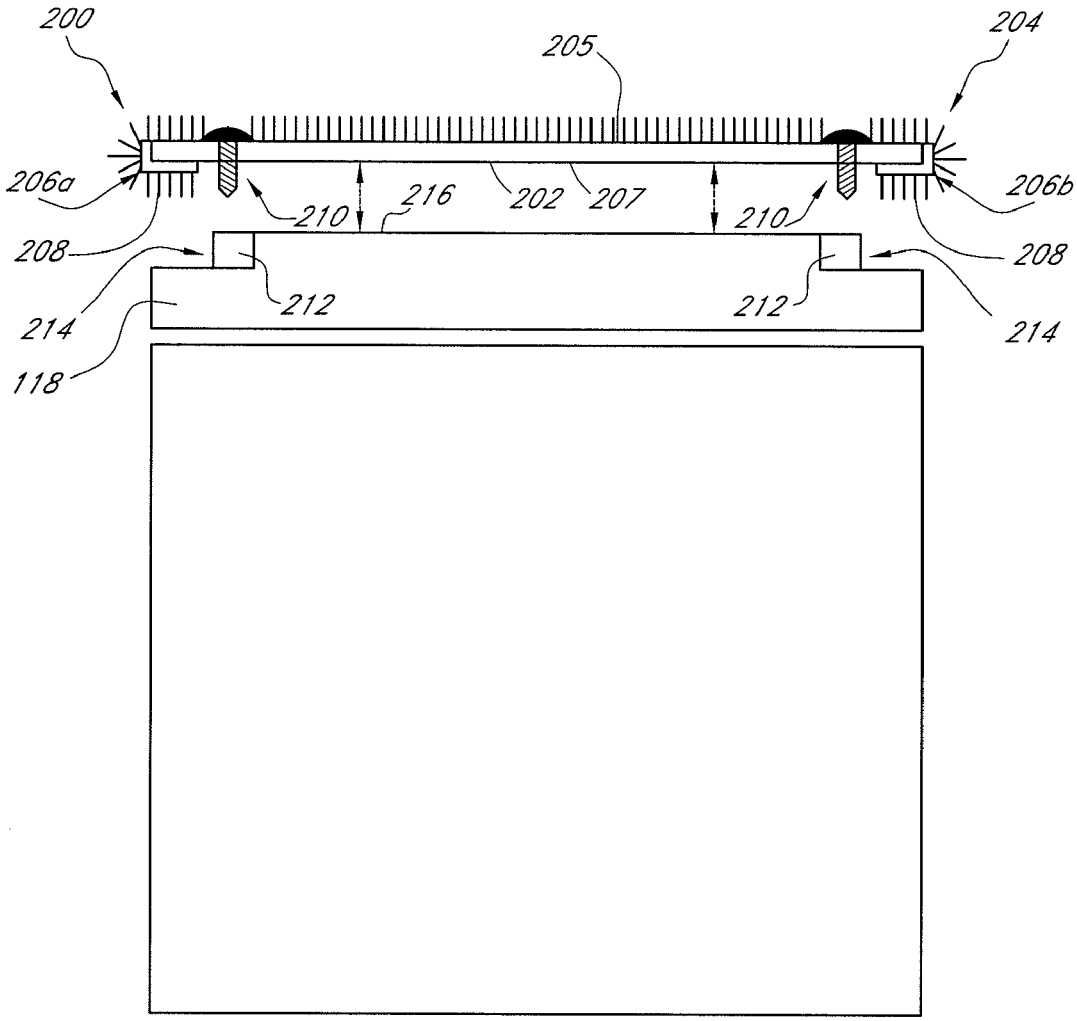
FIG. 3A illustrates the covering system of a preferred embodiment being installed on a crypt lid of a preferred embodiment of the present invention.

As also illustrated in FIG. 2, the lawn crypt system 100 further includes a covering system 200 designed to provide the exposed crypt lid 118 with an appearance that blends in with the surrounding. FIG. 3A shows the covering system 200 as generally including a base support 202 and a layer of artificial lawn 204 positioned thereon. Artificial lawn as used herein shall refer to a variety of different man-made materials including but not limited to artificial turf, man-made grass, sand, pebbles and the like. The base support 202 is preferably a lightweight, rigid material such as a plastic or composite board made of a material such as fiberglass, polyvinylchloride (PVC), acrylonitrile butadiene styrene (ABS), fiber reinforced plastic (FRP), or combinations thereof. In one embodiment, the layer of artificial lawn 204 extends across an upper surface 205 of a fiberglass board 202 and is wrapped around opposing side edges 206*a*, 206*b* of the board in a manner such that a portion 208 of the artificial lawn 204 contacts a lower surface 207 of the board 202. In a preferred implementation, the portion 208 of the artificial lawn 204 is affixed to the lower surface 207 of the board 202 via an adhesive or staples so as to secure the artificial lawn 204 to the board.

As FIG. 3A further illustrates, the covering system 200 also includes a plurality of fasteners 210 extending through both the artificial lawn 204 and the underlying base support 202 so as to further secure the artificial lawn 204 to the base support 202. As will be described in greater detail, the fasteners 210 are preferably adapted to attach to mounting structures formed on the crypt lid 118 so as to attach the covering system to the crypt lid 118. In one embodiment, the base support 202 is configured with a slight curvature in the center such that water coming in contact with the crypt lid will be drained off to the sides into a gravel-based drainage system as shown in FIGS. 1 and 2. Preferably, all materials used in the covering system as well as the fastener are made of water resistant materials.

Figure 3B:
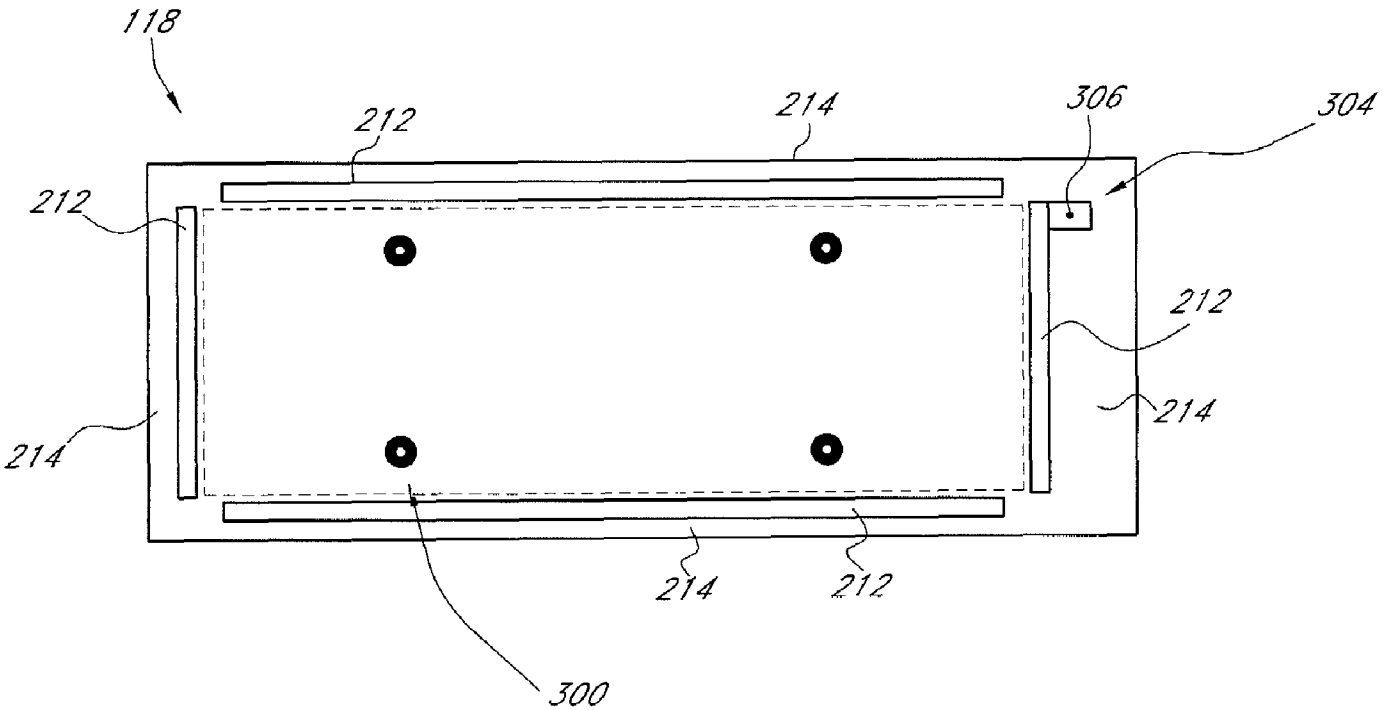
FIG. 3B is a top view of a lawn crypt lid of one preferred embodiment.

FIG. 3B is a top view of the crypt lid 118, showing the recessed areas 214 being formed along the outer periphery of the lid 118. In one embodiment, the crypt lid 118 has at least one edge that is recessed about ⅜ inch. However, it will be appreciated that the crypt lid can have recessed regions of a variety of different dimensions without departing from the scope of the invention. FIG. 3B also shows one or more elongated hollow mounting structures 212 extending along the recessed areas 214. It will be appreciated that the mounting structures 212 do not have to extend the entire length of any recessed area 214 nor does it have to be hollow. For example, the mounting structures 212 can be positioned at pre-selected locations in the recessed areas 214. In certain embodiments, the crypt lid 118 also has a plurality of lifting bolts 300 formed on its upper surface 216 to facilitate removal of the crypt lid without disturbing the covering system 200 attached thereto. In one embodiment, corresponding openings can be formed in the covering system to accommodate the lifting bolts. In other embodiments, a grave identification plate 304 and vase holder 306 can also be formed on the crypt lid 118. Preferably, the grave plate 304 and vase holders 306 are made of granite and/or bronze. In yet other embodiments, the crypt lid 118 is divided into at least two, preferably three, discrete sections that are positioned adjacent each other. Each individual section is independently movable relative to the other sections so as to facilitate removal and mounting of the crypt lid.

FIG. 3B is a top view of the crypt lid 118, showing the recessed areas 214 being formed along the outer periphery of the lid 118. In one embodiment, the crypt lid 118 has at least one edge that is recessed about ⅜ inch. However, it will be appreciated that the crypt lid can have recessed regions of a variety of different dimensions without departing from the scope of the invention. FIG. 3B also shows one or more elongated hollow mounting structures 212 extending along the recessed areas 214. It will be appreciated that the mounting structures 212 do not have to extend the entire length of any recessed area 214 nor does it have to be hollow. For example, the mounting structures 212 can be positioned at pre-selected locations in the recessed areas 214. In certain embodiments, the crypt lid 118 also has a plurality of lifting bolts 300 formed on its upper surface 216 to facilitate removal of the crypt lid without disturbing the covering system 200 attached thereto. In one embodiment, corresponding openings can be formed in the covering system to accommodate the lifting bolts. In other embodiments, a grave identification plate and vase holder 304 can also be formed on the crypt lid 118. Preferably, the grave plate and vase holders are made of granite and/or bronze. In yet other embodiments, the crypt lid 118 is divided into at least two, preferably three, discrete sections that are positioned adjacent each other. Each individual section is independently movable relative to the other sections so as to facilitate removal and mounting of the crypt lid.

Figure 4:
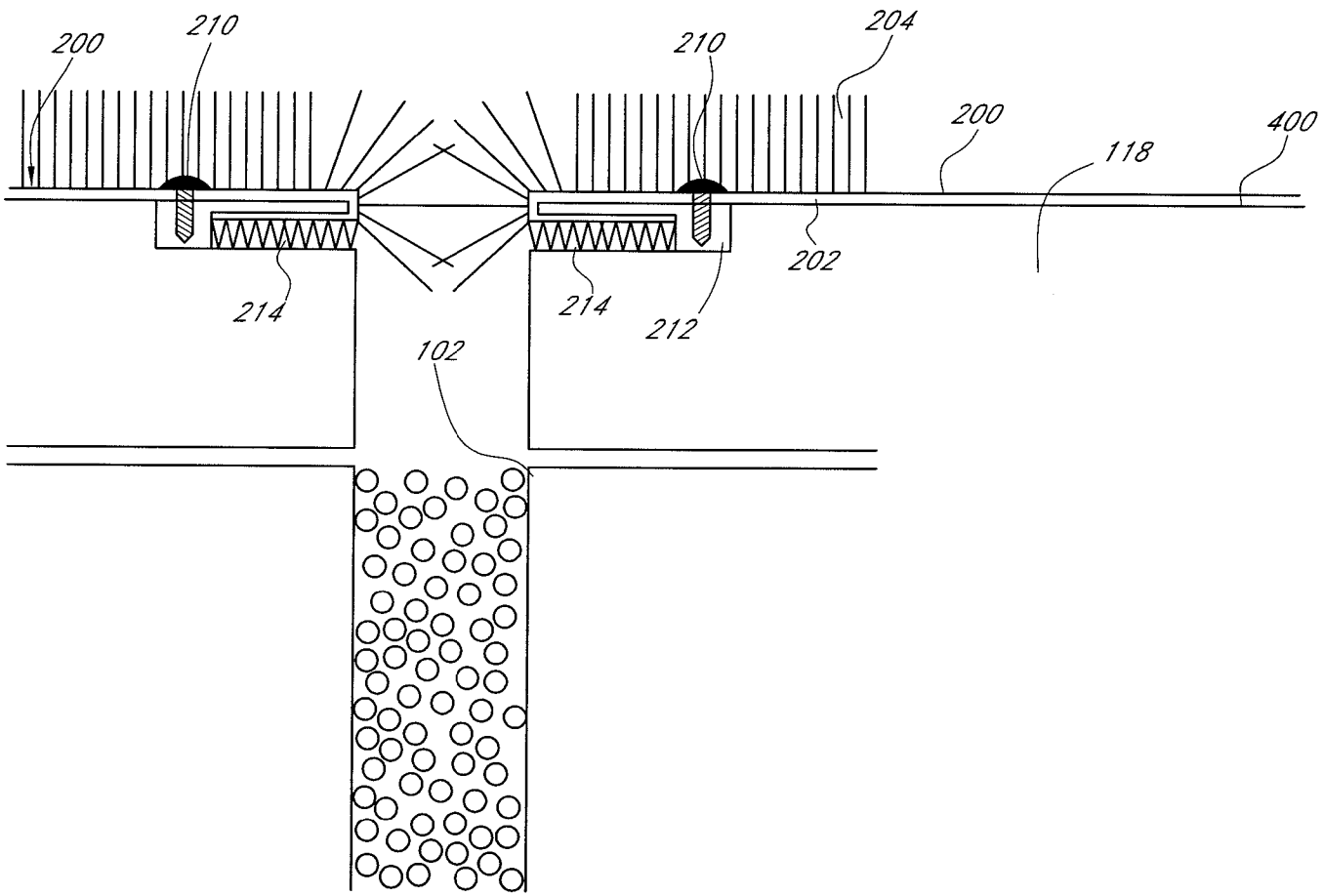
FIG. 4 illustrates an installed lawn crypt covering system of one preferred embodiment of the present invention.

When installed, the covering system 200 is attached to the crypt lid 118 as shown in FIG. 4. The fasteners 210 are inserted through the base support 202 of the covering system 200 into the mounting structure or nailable portion 212 of the crypt lid 118. Additionally, the recessed areas 214 of each crypt lid 118 provide a space for positioning the portion of artificial lawn 204 that wraps over the sides of the support base 202 of the covering. As such, the recessed areas 214 add strength to the bonding of the artificial lawn 204 to its base support 202. In some implementations, a shim 400 can be inserted between the lid 118 and the covering system 200 as a leveling device used to adjust for settling of the crypt 102 below the level of adjoining crypts over time. Additionally, the fasteners 210 preferably can also be adjusted to accommodate the thickness of the shim 400. Advantageously, the shim 400 can be inserted underneath the covering system 200 as a leveling device without having to remove the covering.

The foregoing description of the preferred embodiment of the present invention has shown, described and pointed out the fundamental novel features of the invention. It will be understood that various omissions, substitutions, and changes in the form of the detail of the apparatus as illustrated as well as the uses thereof, may be made by those skilled in the art, without departing from the spirit of the invention. Consequently, the scope of the invention should not be limited to the foregoing discussions, but should be defined by appended claims.

What is claimed is:

1. A lawn crypt covering system, comprising:

a crypt comprising a crypt lid having one or more recessed areas, said crypt further comprising a mounting surface attached thereto, wherein said mounting surface is formed in the one or more recessed areas;

a covering having a lightweight, rigid base support and a layer of artificial lawn attached thereto;

at least one fastener configured to attach the covering to the mounting surface on the crypt so as to secure said covering to the crypt, wherein the mounting surface is configured to receive said at least one fastener.

2. The system of claim 1, wherein the recessed area extends inwardly from at least one edge of the crypt lid by about ⅜ inch.

3. The system of claim 1, wherein the mounting surface is nailable.

4. The system of claim 1, wherein said base support is made of a composite material selected from the group consisting of fiberglass, FRP, PVC, ABS, and combinations thereof.

5. The system of claim 1, further comprising a plurality of bolts positioned on an upper surface of said crypt lid to facilitate removal of the lid.

6. The system of claim 1, further comprising a grave identification plate and flower vase holder formed on an upper surface of said crypt lid.

7. The system of claim 1, further comprising a leveling device positioned between said base support and the crypt lid to adjust for settling of the crypt.

8. The system of claim 1, wherein the system is substantially resistant to water.

9. A lawn crypt covering system, comprising:

a lawn crypt lid having an upper surface comprising at least one recessed area, said recessed area is configured to receive a mounting structure, said mounting structure provides a mounting surface for a fastener; and a covering comprising a man-made material resembling grass, wherein the covering is removably attached to said mounting structure via the fastener.

10. The system of claim 9, wherein said at least one recessed area is formed on the outer periphery of the upper surface of the crypt lid.

11. The system of claim 9, wherein the mounting structure comprises an elongated, hollow material.

12. The system of claim 9, wherein said covering further comprises a lightweight, rigid base support for said man-made material.

13. The system of claim 12, wherein said man-made material extends across an upper surface of the base support and wraps around opposing side edges of the base support.

14. The system of claim 9, wherein said fastener is selected from the group consisting of nails, screws, snaps, and clips.

15. A method of covering a lawn crypt, comprising:

attaching a mounting structure to the crypt, wherein the mounting structure is configured to receive a fastening device, wherein said mounting structure is substantially flush with said crypt;

forming a covering comprising an artificial lawn attached to a support base; and securing the covering to the crypt by removably attaching the fastening device to the mounting structure on the crypt, wherein the crypt comprises a crypt lid, and wherein the mounting structure is attached to the crypt lid.

16. The method of claim 15, wherein the fastening device is extended through and into the covering and mounting structure on the crypt lid.

* * * * *

UNITED STATES PATENT AND TRADEMARK OFFICE

CERTIFICATE OF CORRECTION

PATENT NO. : 7,337,585 B1
APPLICATION NO. : 11/029633
DATED : March 4, 2008
INVENTOR(S) : Gary Bobbitt It is certified that error appears in the above-identified patent and that said Letters Patent is hereby corrected as shown below:

Column 3

Line 61, delete "1110b." and insert -- 110b. --

Column 4

Line 36, after "materials." insert -- As will be described in greater detail below, the covering system in conjunction with the unique crypt lid design permits the covering to be easily mounted and removed from individual crypt lids. Figure 3A shows the crypt lid 118 as comprising a generally rectangular slab having recessed areas 214 formed thereon. In one embodiment, the recessed areas 214 are elongated channels or grooves extending along the edges of the slab. Additionally, the lid 118 also includes a plurality of mounting structures 212 adapted to receive the fasteners 210 of the covering system 200. Preferably, the mounting structures 212 are placed in the recessed areas 214 formed on the crypt lid. In one embodiment, the crypt lid 118 has a plurality of recess areas 214 formed on its upper surface 216. In some preferred embodiments, the entire outer periphery of the crypt lid 118 is recessed relative to the top surface of the lid. In certain embodiments, the mounting structures 212 are elongated plastic or wooden bars that are nailable and/or contain predrilled holes for receiving the fastener. As such, the covering system 200 can be repeatedly attached to and removed from the crypt lid via the fastener and the special configuration of the crypt lid. --

UNITED STATES PATENT AND TRADEMARK OFFICE

CERTIFICATE OF CORRECTION

PATENT NO. : 7,337,585 B1
APPLICATION NO. : 11/029633
DATED : March 4, 2008
INVENTOR(S) : Gary Bobbitt It is certified that error appears in the above-identified patent and that said Letters Patent is hereby corrected as shown below:

Column 4-5

Line 65-67 and 1-24 - After "crypt lid." delete "FIG. 3B is a top view of the crypt lid 118, showing the recessed areas 214 being formed along the outer periphery of the lid 118. In one embodiment, the crypt lid 118 has at least one edge that is recessed about 3/8 inch. However, it will be appreciated that the crypt lid can have recessed regions of a variety of different dimensions without departing from the scope of the invention. FIG. 3B also shows one or more elongated hollow mounting structures 212 extending along the recessed areas 214. It will be appreciated that the mounting structures 212 do not have to extend the entire length of any recessed area 214 nor does it have to be hollow. For example, the mounting structures 212 can be positioned at pre-selected locations in the recessed areas 214. In certain embodiments, the crypt lid 118 also has a plurality of lifting bolts 300 formed on its upper surface 216 to facilitate removal of the crypt lid without disturbing the covering system 200 attached thereto. In one embodiment, corresponding openings can be formed in the covering system to accommodate the lifting bolts. In other embodiments, a grave identification plate and vase holder 304 can also be formed on the crypt lid 118. Preferably, the grave plate and vase holders are made of granite and/or bronze. In yet other embodiments, the crypt lid 118 is divided into at least two, preferably three, discrete sections that are positioned

UNITED STATES PATENT AND TRADEMARK OFFICE

CERTIFICATE OF CORRECTION

PATENT NO. : 7,337,585 B1
APPLICATION NO. : 11/029633
DATED : March 4, 2008
INVENTOR(S) : Gary Bobbitt It is certified that error appears in the above-identified patent and that said Letters Patent is hereby corrected as shown below:

adjacent each other. Each individual section is independently movable relative to the other sections so as to facilitate removal and mounting of the crypt lid."

Signed and Sealed this

Twenty-sixth Day of August, 2008

JON W. DUDAS
*Director of the United States Patent and Trademark Office*